United States Patent [19]

Voelz

[11] 4,167,958

[45] Sep. 18, 1979

[54] HYDROCARBON FUEL DISPENSING, VAPOR CONTROLLING SYSTEM

[75] Inventor: Frederick L. Voelz, Orland Park, Ill.

[73] Assignee: Atlantic Richfield Company, Philadelphia, Pa.

[21] Appl. No.: 888,054

[22] Filed: Mar. 20, 1978

[51] Int. Cl.[2] ..... B65B 3/18

[52] U.S. Cl. ..... 141/95; 141/198; 141/290; 141/DIG. 2

[58] Field of Search ..... 141/59, 93–96, 141/192, 198, 206–229, 285, 290, 392, DIG. 2; 137/806, 836, 557, 558

[56] References Cited

U.S. PATENT DOCUMENTS 3,996,977 12/1976 Hansel ..... 141/392

3,996,979 12/1976 Barr et al. ..... 141/392

*Primary Examiner*—Richard E. Aegerter
*Assistant Examiner*—Frederick R. Schmidt
*Attorney, Agent, or Firm*—Frank J. Uxa; Stanley M. Welsh

[57] ABSTRACT

An improvement in a liquid dispensing, vapor controlling system is disclosed. The improvement senses and responds to the presence of fuel flowing in the vapor passageways of the system and to the existence of a safe maximum pressure in a vehicle fuel tank with which the system is utilized. The improvement draws power from the movement of liquid fuel in the liquid fuel dispensing passageway of the system through the action of an aspirator.

34 Claims, 3 Drawing Figures

Fig. 1
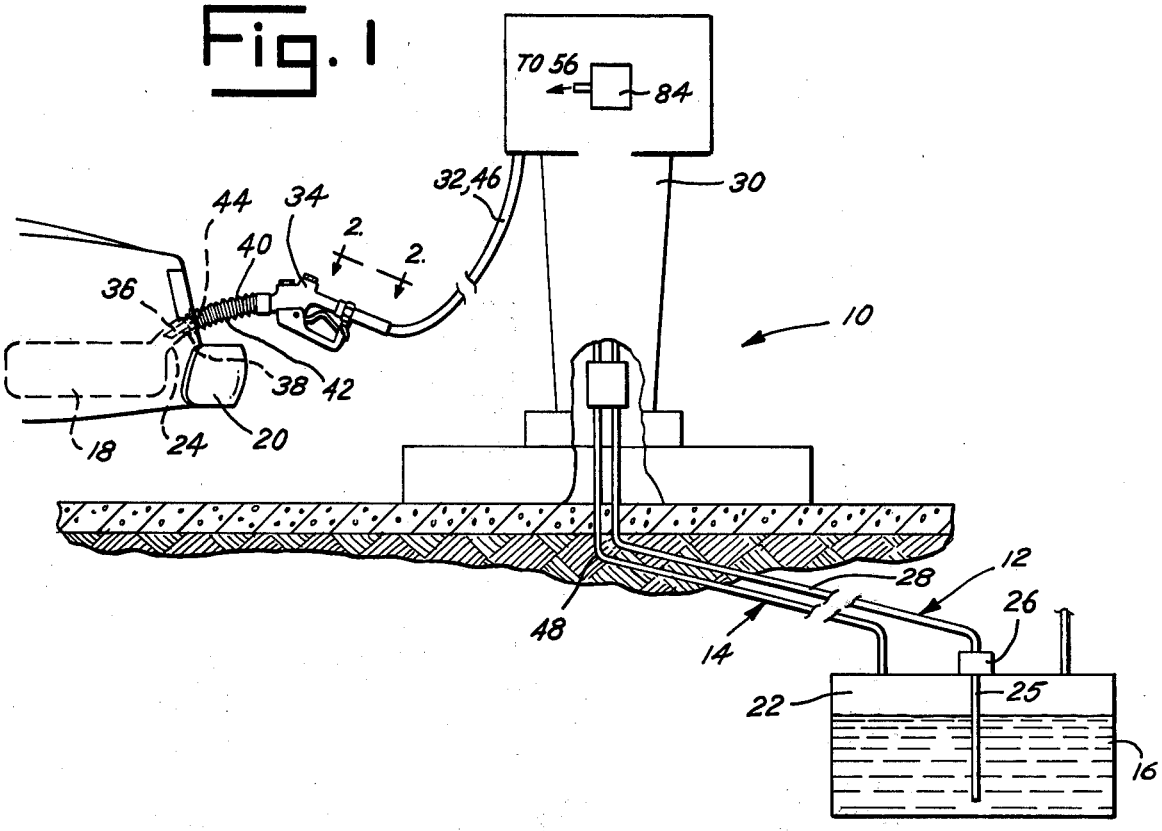
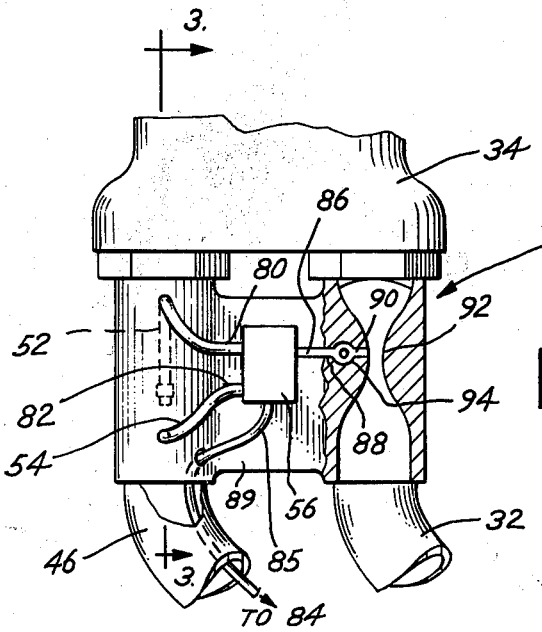
Fig. 2

HYDROCARBON FUEL DISPENSING, VAPOR CONTROLLING SYSTEM

BACKGROUND OF THE INVENTION

The present invention relates to a liquid dispensing, vapor controlling system. More particularly, the present invention relates to an improvement in such a system for sensing and responding (1) to the flow of liquid in the vapor passageway thereof, and (2) to the existance of an abnormal pressure in a liquid receiver with which the system is utilized.

In a variety of industries, volatile liquids are stored in bulk and dispensed in small, metered quantities to liquid receivers. For example, in the industry of servicing hydrocarbon burning vehicles, e.g., automobiles, liquid hydrocarbon fuel, e.g., gasoline, is often stored at service facilities in underground storage tanks and intermittently dispensed to the fuel tanks of the vehicles in metered quantities. To contain the hazardous vapors displaced from a liquid receiver during such a liquid dispensing operation, and prevent overfilling of the liquid receiver, a variety of liquid dispensing, vapor controlling systems have been disclosed. In the vehicle service industry, such systems typically include a nozzle having a spout, a vapor recovery means mounted on the nozzle about the spout, a vapor passageway open to the vapor recovery means, and an overfill sensor on the tip of the spout. Ideally, vapors are collected in the vapor recovery means and passed through the vapor passageway while fuel is dispensed out the spout, and the overfill sensor triggers termination of the fuel dispensing operation whenever the fuel tank is full. However, because of styling considerations, space limitations and the like, some automobiles have been produced which have fuel tank fillpipes so located and oriented that fuel cannot be dispensed into the fuel tanks thereof without overflow and overfill not sensed by a conventional overfill sensor. Consequently, a quantity of fuel may circulate through the vapor recovery means and the vapor passageway during the dispensing of fuel to such a vehicle. As a result of this circulation, the meter reading of the quantity of fuel dispensed to the automobile may be inaccurate, and liquid fuel may block the vapor passageway. If the vapor passageway does become blocked, the fuel tank may be pressurized beyond a safe, maximum limit.

SUMMARY OF THE INVENTION

In light of the problems set forth above, a principal object of the present invention is to provide an improvement in a liquid dispensing, vapor controlling system. Specifically, a principal object of the invention is to provide an improvement in a liquid hydrocarbon fuel dispensing, hydrocarbon vapor controlling system.

Another object of the present invention is to provide an improvement which may be utilized with secondary, vapor balance and hybrid type liquid dispensing, vapor controlling systems.

A further principal object of the present invention is to provide an improvement for sensing and responding to the presence of a predetermined amount, i.e., time rate, of liquid flowing in the vapor passageway of such a system.

A further principal object of the present invention is to provide an improvement for sensing the existence of a preselected pressure, e.g., less than a safe maximum pressure, in a liquid receiver, e.g., an automobile fuel tank.

Another object of the present invention is to provide an improvement for activating a signal device such as a mechanical indicator, a warning light, an audial alarm, or an electrical switch or the like for terminating the liquid dispensing operation.

Another object of the present invention is to provide an improvement which necessitates no modification of the liquid receiver, e.g., the automobile fuel tank.

Another object of the present invention is to provide an improvement, the sensors of which may be mounted within the dispensing nozzle or adjacent the heel thereof within the vapor passageway.

Another object of the present invention is to provide an improvement which operates reliably without regard to the orientation or position of the dispensing nozzle.

A further object of the present invention is to provide an improvement which presents a minimal hazard of explosion of the vapors being controlled.

A further object of the present invention is to provide an improvement in such a system which draws power from the movement of liquid in the liquid dispensing passageway of the system.

A further object of the present invention is to provide an improvement in such a system which introduces little or no gas, e.g. air, into the vapor passageway during its operation.

Still further objects of the present invention are to provide an improvement in such a system which is durable, requires little or no maintenance, is mechanically streamlined and low in production costs.

Thus, in a liquid hydrocarbon fuel dispensing, vapor controlling system having a liquid fuel passageway and a vapor passageway, the present invention is, in a principal aspect, an improvement of apparatus for sensing and responding to the flow of liquid in the vapor passageway. The improvement is adapted to be utilized with a device for generating a signal in response to a preselected gas flow. Included in the apparatus, as preferred, is a first sensor having a first port opening into the vapor passageway and/or a second sensor having a second port opening into the vapor passageway. In communication with the liquid fuel passageway is an aspirator for aspirating a flow of gas in response to the flow of liquid fuel in the liquid fuel passageway. The first port and the second port are located so that when a predetermined rate of liquid is flowing in the vapor passageway, the first port is at least partially blocked with liquid and the second port is substantially clear thereof.

A controller is included, which has a fluidic means, a first inlet in communication with the first sensor and/or a second inlet in communication with the second sensor, a third inlet in communication with the aspirator, and an outlet in communication with the signal device. The controller powered by the aspirator, causes a given vacuum in the first sensor, monitors the flow therein and generates a pre-selected gas flow in the outlet to activate the signal device when the flow of gas in the first sensor is reduced. In the embodiment of the present invention in which a second sensor, located as noted above, is employed, the controller powered by the aspirator causes a given vacuum in the second sensor, monitors the gas flow therein and generates a pre-selected gas flow in the outlet to activate the signal device when the flow of gas in the second sensor is increased.

BRIEF DESCRIPTION OF THE DRAWING

The preferred embodiment of the present invention will be described in relation to the accompanying drawing, wherein:

FIG. 1 is an elevation view of a liquid fuel dispensing, vapor balance vapor recovery system incorporating the preferred embodiment of the present invention;

FIG. 2 is a top plan view taken along line 2—2 of FIG. 1, with the liquid fuel passageway of the system depicted in partial cross-section.

DETAILED DESCRIPTION OF THE PREFERRED EMBODIMENT

Figure 3:
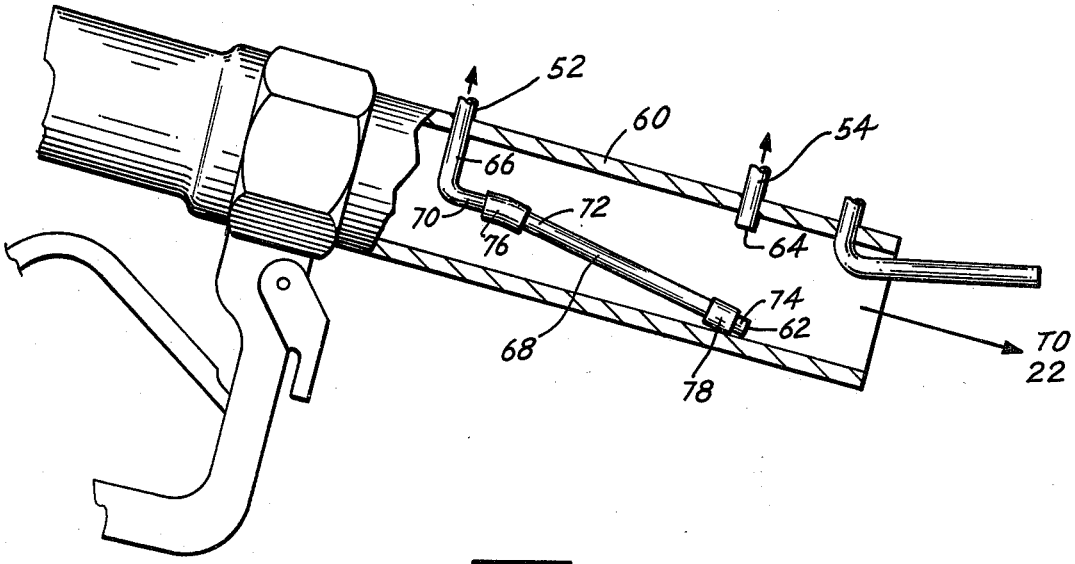
FIG. 3 is a partial, cross-section view of the vapor passageway of the system of FIG. 1, taken along line 3—3 of FIG. 2.

Referring to FIG. 1, the present invention is considered to be suitable for a variety of liquid dispensing, vapor controlling systems, e.g., secondary, vapor balance and hybrid systems. Because the present invention has application to a liquid hydrocarbon fuel dispensing, vapor recovery system 10 of the vapor balance type, the present invention will be described with reference thereto.

Briefly, the system 10 includes a liquid fuel dispensing subsystem 12 and a vapor recovery subsystem 14. The system 10 is utilized to intermittently dispense liquid hydrocarbon fuel, e.g., gasoline, from a course such as an underground storage vessel 16 to the fuel tanks of vehicles, such as the fuel tank 18 of the automobile 20. Vapors displaced from the fuel tank 18 are routed therefrom to the vapor space 22 of the storage vessel 16.

More specifically, the subsystem 12 includes or is connected to a fuel inlet tube 25 located in the storage vessel 16 and a fuel propelling mechanism such as a turbine 26. Mounted in the vessel 16, the turbine 26 propels gasoline through a liquid fuel passageway that includes a conduit 28 to an above-ground dispenser 30. From there, the gasoline is delivered through flexible hose 32 to a dispensing nozzle 34.

As shown, the nozzle 34 has an elongated, generally cylindrical spout 36 which may be placed in the inlet 24 of the automobile fuel tank 18. To automatically retain the spout 36 in the inlet 24, the spout 36 includes a latch mechanism 38. Mounted on the nozzle 34 is a vapor collector such as a flexible bellows 40. The bellows 40 surrounds the spout 36 and has attached to the free end 42 thereof a rigid annular face plate 44. When the spout 36 is placed in the inlet 24 and latched, the bellows 40 flexes or compresses to resiliently maintain a substantially vapor-tight seal between the face plate 44 and the protruding lip of the inlet 24. Thus, gasoline may be dispensed into the fuel tank 18, with the vapors displaced by the entering gasoline collected or captured in the bellows 40.

The dispenser 30 has mounted therein a metering mechanism (not shown) for metering the fuel dispensed to the nozzle 34. As typical, the customer whose automobile is fueled is charged according to a visually displayed reading. Also mounted on the dispenser 30 is a main electrical control or switch (not shown) which is manually tripped to reset the metering mechanism and energize the turbine 26. Overriding the main control is a second control (not shown), mounted in the nozzle 34 and controlled by the movement of the face plate 44. Fuel is thus dispensed out the spout 36 only when the spout 36 is latched to the inlet 24 or when the face plate 44 is firmly held against the resilience of the bellows 40.

In addition to the bellows 40, the vapor recovery subsystem 14 includes a vapor passageway that has a flexible hose 46 thereof open to or in vapor communication with the bellows 40. As desired, the hoses 32, 46 may be physically separated, twinned in a side-by-side relationship or joined coaxially. The hose 46 extends to the dispenser 30 and a conduit 48 open thereto extends to the vapor space 22.

As fuel is dispensed from the storage tank 16 to the automobile 20, the increasing volume of the vapor space 22 results in a decreasing pressure of the vapor therein, while the decreasing volume of the vapor space in the fuel tank 18 results in an increasing pressure of the vapor therein. This pressure difference propels the vapor through the vapor passageway to the vapor space 22.

In a system 10 as thus described, the preferred embodiment of the present invention is an apparatus 50 which includes two sensors 52, 54, a controller 56, and an aspirator 88, utilized with a signal device 84 mounted in dispenser 30. As shown in FIG. 2, the sensors 52, 54, the controller 56 and the aspirator 88 are located adjacent the heel of the nozzle 34, mounted on a brace or support member 89. With the sensors 52, 54, the controller 56 and the aspirator 88 thus located, the apparatus 50 may be added to a pre-existing system 10. Further, the signal device 84 may also be mounted on the nozzle or in the dispenser or the like, as desired.

Referring to FIG. 3, the first sensor 52, formed in two sections 66, 68 of substantially rigid tubing, for example, having a diameter of approximately 0.10 inches, is attached to the sidewall 60 of the hose 46 and extends therethrough to define a first opening or port 62 within the vapor passageway. The second sensor 54, similarly formed, in a single section, extends through the sidewall 60 to define a second opening or port 64.

The second port 64 is located adjacent the sidewall 60, toward the top of the hose 46 as oriented when the nozzle 34 is in a typical dispensing position. The second port 64 is thus normally substantially clear of liquid fuel. As used herein, the term "normally" includes substantially all circumstances except when the hose 46 (the vapor passageway) is substantially filled with liquid.

As stated, the first sensor 52 includes two sections 66, 68. The first section 66 is fixedly attached to the sidewall 60 and has an end 70 that turns in the direction of the dispenser 30, i.e., the downstream direction. The second section 68, which is substantially straight, is joined at the end 72 to the end 70 and extends downstream to a free end 74, where the first port 62 is defined. Joining the ends 70, 72 is a flexible coupling 76. Mounted on the free end 74 is a weighted collar 78. The coupling 76 flexes to allow the second section 68 to pivot about the end 72. The free end 74, weighted by the collar 78, thus remains at or near the bottom of the hose 46, in a plurality of orientations of the nozzle 34. As a result, the first port 62 is at least partially blocked with fuel when liquid fuel flows in the hose 46.

Referring now to FIG. 2, the sensors 52, 54 are connected to the controller 56, which is also connected to the aspirator 88 and to the signal device 84. As preferred, the connections are made through flexible tubing mounted on the support member 89. The first sensor 52 is connected to a first inlet 80 of the controller 56, the second sensor 54 is connected to a second inlet 82 thereof and the aspirator 88 is connected to a third inlet 86 thereof. The signal device 84 is connected to an outlet 85. If the controller 56 and the signal device 84 are mounted in the dispenser 30, the connection between the sensors 52, 54 and the controller 56 may be made by tubing placed within the hose 46, to prevent damage thereto. If, alternatively, the controller 56 is mounted on the nozzle 34 and the signal device 84 is mounted in the dispenser 30, tubing from the signal device may be placed within the hose 46. Further, the controller 56 and signal device 84 may both be mounted on the nozzle 54. In this embodiment, the signal device 84 acts as a warning device.

As preferred, the signal device 84 is an electro-pneumatic valve or switch or the like for terminating the fuel dispensing operation in response to a predetermined pressure at the outlet 85. The apparatus 50 may be utilized, however, with a variety of other pressure-responsive signal devices, such as those which mechanically raise an indicator, flash a warning light, or broadcast an alarm. As stated above, the signal device 84 may be mounted where desired. If however, a signal device 84 having electrical components is utilized, it is preferably mounted away from the nozzle 34, to provide improved safety.

As briefly stated, the aspirator 88 is connected to the inlet 86. The aspirator 88 includes an aspirator tube 90 which opens into the fuel passageway at a venturi 92 defined therein. As liquid fuel is being dispensed through the fuel passageway, it flows through the venturi 92, and the aspirator 88 causes a vacuum to be created in the aspirator tube 90. Contained within the aspirator tube 90 is a liquid check valve 94. The check valve 94 allows gas from the third inlet 86 to enter the fuel passageway, and prevents the flow of liquid toward the controller 56, under any condition wherein fuel is present in the hose 32. The vacuum created by the aspirator 88 powers the controller 56 and thus the apparatus 50.

Turning now to the controller 56, contained therein is a fluidic circuit including at least one fluidic device and such peripheral fluidic components as fixed and variable flow restrictors and the like. Following is a specification of the operating characteristics of the apparatus 50. Based upon this specification, it is believed that a person of average skill in the art of designing fluidic circuits could readily design the fluidic circuit of the controller 56, and select fluidic devices suitable therefore, from among the conventional fluidic devices available from manufacturers such as Corning Glass Works.

The operation of the apparatus 50 is thus as follows. When normal or steady state conditions prevail in the system 10, i.e., when fuel is being dispensed through the fuel passageway, when the vapor passageway is not blocked, and when substantially only vapors are flowing in the vapor passageway, the controller 56 causes a slight flow of vapors to enter the ports 62, 64 from the hose 46. The flow into the port 62 is approximately equal to that into the port 64. The vapors thus pulled into the sensors 52, 54 pass through the controller 56, through the aspirator 88 and into the fuel flowing in the hose 32. The controller 56 does not cause the pre-determined pressure to exist in the outlet 85.

When liquid enters the vapor passageway and, more specifically, the hose 46, the first port 62 is at least partiably blocked with fuel, as stated above. The vacuum in the sensor 52 rises above its normal or steady state condition and is, thus greater than that in sensor 54. This reduction in pressure in sensor 52 is sensed by the controller 56, which causes the pre-determined pressure to occur in the outlet 85. The signal device 84 is thus triggered, and, as preferred, the dispensing operation is terminated.

If desired, the controller 56 or the signal device 84 may contain a time device so that liquid would need to be sensed for a set period of time prior to the sending of the signal. Because the apparatus 50 operates using the vacuum of the aspirator 88 as its power source, may liquid entering the sensor 52 is pulled into the fuel passageway, thereby purging or cleaning the sensor port 62.

When the pressure in the vapor passageway rises above a pre-set pressure, chosen to maintain a safe maximum pressure in the fuel tank 18, the pressure rises at the ports 62, 64, increasing the flow in the sensors 52, 54. The controller 56 senses this change and causes the signal device 84 to be triggered. The apparatus 50, as preferred, thus senses and responds to the flow of a predetermined rate of fuel in the hose 46, and to a pressure increase in the fuel tank 18.

From the foregoing, it should be apparent to those having average skill in the art that the improvement of the present invention as described herein could be modified and the present invention embodied in alternative equivalent forms. For example, with the utilization of suitable flow restrictors, the flow in the sensors 52, 54, during normal conditions, could be set at a variety of proportions. Accordingly, the preferred embodiments should be considered as illustrative and not restrictive, the scope of the claimed invention being measured by the following claims.

What is claimed is:

1. In a liquid dispensing, vapor controlling system having a liquid passageway and a vapor passageway, the improvement of apparatus for sensing and responding to the presence of a predetermined rate of liquid flowing in the vapor passageway, said apparatus adapted to be utilized with means for generating a signal in response to a predetermined gas flow and comprising, in combination:

sensor means for defining at least one port opening into said vapor passageway, said port located within said vapor passageway so that when said predetermined rate of liquid is flowing therein, said port is at least partially blocked with liquid;

means in communication with the liquid passageway for aspirating a flow of gas in response to the flow of liquid in the liquid passageway;

control means having an inlet in communication with said sensor means, an inlet in communication with said aspirator means, an outlet in communication with said signal means, said control means causing a predetermined time rate of gas flow in said sensor means for automatically monitoring the gas flow therein and for generating said predetermined gas flow in said outlet whenever the flow in said sensor means varies from said predetermined time rate;

whereby said apparatus generates said signal in response to said predetermined rate of liquid flowing in said vapor passageway and at least partial blockage of said port.

2. An improvement as claimed in claim 1 wherein said fluidic means comprises at least one control device.

3. An improvement as claimed in claim 2 wherein said control means comprises a single fluidic device.

4. An improvement as claimed in claim 1 for sensing and responding to the presence of a predetermined rate of liquid flowing in a vapor passageway of a system movable to at least two orientations, said port located within said vapor passageway so that in either of said two orientations, whenever said predetermined rate of liquid is flowing in said vapor passageway, said port is at least partially blocked with liquid.

5. An improvement as claimed in claim 1 for sensing and responding to the presence of a predetermined rate of liquid flowing in a vapor passageway of a system movable to a plurality of orientations, said port located within said vapor passageway so that in any of said plurality of said orientations, when said predetermined rate of said liquid is flowing in said vapor passageway said port is at least partially blocked with liquid.

6. An improvement as claimed in claim 5 wherein said sensor means includes means for locating said port substantially at the lowest point in a cross section of said vapor passageway in any of said plurality of orientations.

7. An improvement as claimed in claim 6 wherein said sensor means includes a first section and a second section having a free end on which said port is defined, said locating means including means for flexibly connecting said first section to said second section and means for weighting said free end toward said lowest point.

8. An improvement as claimed in claim 1 wherein said control means causes said flow of gas in said sensor means from said vapor passageway toward said aspirator means.

9. An improvement as claimed in claim 1 wherein said aspirator means comprises an aspirator.

10. An improvement as claimed in claim 9 wherein said liquid passageway has a venturi therein and said aspirator communicates with said venturi.

11. An improvement as claimed in claim 1 further comprising means for checking the flow of liquid from said liquid passageway into said aspirator means.

12. An improvement as claimed in claim 11 wherein said check means comprises a check valve.

13. An improvement as claimed in claim 1 wherein said port is substantially fully blocked with liquid when said predetermined rate of liquid is flowing in said vapor passageway.

14. In a liquid dispensing, vapor controlling system having a liquid passageway and a vapor passageway, the improvement of apparatus for sensing and responding to the presence of a predetermined pressure in the vapor passageway, said apparatus adapted to be utilized with means for generating a signal in response to a predetermined gas flow and comprising, in combination:

sensor means for defining at least one port opening into said vapor passageway;

means in communication with the liquid passageway for aspirating a flow of gas in response to the flow of liquid in said liquid passageway;

control means having an inlet in communication with said sensor means, an inlet in communication with said aspirator means, an outlet in communication with said signal means, said control means causing a predetermined time rate of gas flow in said sensor means for automatically monitoring the gas flow therein and for generating said predetermined gas flow in said outlet whenever the flow in said sensor means varies from said predetermined time rate;

whereby said apparatus generates said signal in response to said predetermined pressure in said vapor passageway.

15. An improvement as claimed in claim 14 wherein said fluidic means comprises at least one control device.

16. An improvement as claimed in claim 15 wherein said control means comprises a single fluidic device.

17. An improvement as claimed in claim 14 wherein said port is located within said vapor passageway as to be substantially clear of liquid whenever liquid is flowing in said vapor passageway.

18. An improvement as claimed in claim 14 wherein said control means causes a flow of gas in said sensor means from said vapor passageway toward said aspirator means.

19. An improvement as claimed in claim 14 wherein said aspirator means comprises an aspirator.

20. An improvement as claimed in claim 19 wherein said liquid passageway has a venturi therein and said aspirator communicates with said venturi.

21. An improvement as claimed in claim 14 further comprising means for checking the flow of liquid from said liquid passageway into said aspirator means.

22. In a liquid dispensing, vapor controlling system having a liquid passageway and a vapor passageway, the improvement of apparatus for sensing and responding to the presence of a predetermined rate of liquid flowing in the vapor passageway and to the presence of a predetermined maximum pressure therein, said apparatus adapted to be utilized with means for generating a signal in response to a predetermined gas flow of comprising, in combination:

first sensor means for defining a first port opening into said vapor passageway;

second sensor means for defining a second port opening into said vapor passageway;

the first port and the second port located within said vapor passageway so that when said predetermined rate of liquid is flowing therein, said first port is at least partially blocked with liquid and said second port is substantially clear thereof;

means in communication with the liquid passageway for aspirating a flow of gas in response to the flow of liquid in the liquid passageway; and control means having an inlet in communication with said first sensor means, an inlet in communication with said second sensor means, an inlet in communication with said aspirator means, an outlet in commucation with said signal means, said control means causing a predetermined time rate of gas flow in said first sensor means and said second sensor means for automatically monitoring the gas flow therein and for generating said predetermined gas flow in said outlet whenever the flow in said first sensor means varies from said predetermined time rate and whenever the flow in said second sensor means varies from said predetermined time rate;

whereby said apparatus generates said signal in response to said predetermined rate of liquid flowing in said vapor passageway and at least partial blockage of said first port, and in response to said predetermined maximum pressure in said vapor passageway.

23. An improvement as claimed in claim 22 wherein said fluidic means comprises at least one control device.

24. An improvement as claimed in claim 23 wherein said control means comprises a single fluidic device.

25. An improvement as claimed in claim 22 for sensing and responding to the presence of a predetermined rate of liquid flowing in a vapor passageway of a system movable to at least two orientations, said first port and said second port located within said vapor passageways so that in either of said two orientations, whenever said predetermined rate of liquid is flowing in said vapor passageway, said first port is at least partially blocked with liquid and said second port is substantially clear thereof.

26. An improvement as claimed in claim 22 for sensing and responding to the presence of a predetermined rate of liquid flowing in a vapor passage of a system movable to a plurality of orientations, said first port and said second port located within said vapor passageways so that in any of said plurality of said orientations, when said predetermined rate of said liquid is flowing in said vapor passageway said first port is at least partially blocked with liquid and said second port is substantially clear thereof.

27. An improvement as claimed in claim 26 wherein said first sensor means includes means for locating said first port substantially at the lowest point in a cross section of said vapor passageway in any of said plurality of orientations.

28. An improvement as claimed in claim 27 wherein said first sensor means includes a first section and a second section having a free end on which said first port is defined, said locating means including means for flexibly connecting said first section to said second section and means for weighting said free end towards said lowest point.

29. An improvement as claimed in claim 22 wherein said control means causes said flow of gas in said first sensor means and in said second sensor means from said vapor passageway to move toward said aspirator means.

30. An improvement as claimed in claim 22 wherein said aspirator means comprises as aspirator.

31. An improvement as claimed in claim 30 wherein said liquid passageway has a venturi therein and said aspirator communicates with said venturi.

32. An improvement as claimed in claim 22 further comprising means for checking the flow of liquid from said liquid passageway into said aspirator means.

33. An improvement as claimed in claim 32 wherein said check means comprises a check valve.

34. An improvement as claimed in claim 22 wherein said first port is substantially fully blocked with liquid when said predetermined rate of liquid is flowing in said vapor passageway.

* * * * *

UNITED STATES PATENT AND TRADEMARK OFFICE

CERTIFICATE OF CORRECTION

PATENT NO. : 4,167,958
DATED : September 18, 1979
INVENTOR(S) : Frederick L. Voelz It is certified that error appears in the above-identified patent and that said Letters Patent are hereby corrected as shown below:

In claim 2, line 2, delete "fluidic" and insert in place thereof -- control --.

line 2, delete "control" and insert in place thereof -- fluidic --.

In claim 15, line 2, delete "fluidic" and insert in place thereof -- control --.

line 2, delete "control" and insert in place thereof -- fluidic --.

In claim 23, line 2, delete "fluidic" and insert in place thereof -- control --; same line, delete "control" and insert -- fluidic --.

Signed and Sealed this

*First* Day of *January 1980*

[SEAL]

*Attest:*

SIDNEY A. DIAMOND

*Attesting Officer*

*Commissioner of Patents and Trademarks*